US008631520B2

(12) United States Patent
Henne

(10) Patent No.: US 8,631,520 B2
(45) Date of Patent: Jan. 21, 2014

(54) SELF-SUSTAINING TOILET SEAT HINGE ASSEMBLY

(75) Inventor: Brian A. Henne, Plymouth, WI (US)

(73) Assignee: Bemis Manufacturing Company, Sheboygan Falls, WI (US)

( * ) Notice: Subject to any disclaimer, the term of this patent is extended or adjusted under 35 U.S.C. 154(b) by 1053 days.

(21) Appl. No.: 12/495,949

(22) Filed: Jul. 1, 2009

(65) Prior Publication Data

US 2011/0000010 A1 Jan. 6, 2011

(51) Int. Cl.
*A47K 13/12* (2006.01)

(52) U.S. Cl.
USPC ..... 4/236; 4/240; 4/246.1; 16/337

(58) Field of Classification Search
USPC ..... 4/236, 237, 240, 246.1; 16/337, 385; 29/525
See application file for complete search history.

(56) References Cited

U.S. PATENT DOCUMENTS

| | | | | |
|---|---|---|---|---|
| 1,967,104 | A * | 7/1934 | Sorrow, Jr. | 4/236 |
| 2,500,594 | A * | 3/1950 | Young | 4/236 |
| 2,787,006 | A | 4/1957 | Young | |
| 2,901,753 | A | 9/1959 | Sperzel | |
| 3,068,508 | A * | 12/1962 | Heyer | 16/386 |
| 3,474,470 | A * | 10/1969 | Watson | 4/240 |
| 4,213,211 | A | 7/1980 | Bemis et al. | |
| 4,391,001 | A * | 7/1983 | Harrison | 4/236 |
| 4,489,447 | A | 12/1984 | Umehara | |
| 4,639,147 | A | 1/1987 | Schwarz | |
| 4,914,781 | A | 4/1990 | Sokn et al. | |
| 4,962,551 | A | 10/1990 | Bly | |
| 4,965,890 | A * | 10/1990 | Fischer | 4/240 |
| 5,341,517 | A | 8/1994 | Bly | |
| 5,414,875 | A | 5/1995 | Kappl et al. | |
| 5,491,874 | A | 2/1996 | Lowry et al. | |
| 5,752,293 | A | 5/1998 | Lowry et al. | |
| 5,992,426 | A | 11/1999 | Yuhara | |
| 6,006,369 | A | 12/1999 | Bly | |
| 6,230,365 | B1 | 5/2001 | Lu | |
| 6,381,809 | B2 | 5/2002 | Uneme et al. | |
| 6,871,384 | B2 | 3/2005 | Novin et al. | |
| 2007/0089222 | A1 | 4/2007 | Leibfried | |
| 2007/0090249 | A1 * | 4/2007 | Lu et al. | 248/291.1 |
| 2010/0199414 | A1 * | 8/2010 | Shannon | 4/236 |

FOREIGN PATENT DOCUMENTS

| | | |
|---|---|---|
| JP | 2002115713 | 4/2002 |

OTHER PUBLICATIONS

PCT/US2010/040576 International Search Report and Written Opinion.

* cited by examiner

*Primary Examiner* — Gregory Huson
*Assistant Examiner* — Lauren Heitzer
(74) *Attorney, Agent, or Firm* — Michael Best & Friedrich LLP

(57) ABSTRACT

A hinge assembly for a toilet having a bowl and a seat includes a hinge post configured to mount to the bowl. The hinge post includes a splined inner surface defining a bore. The hinge assembly also includes a pintle extending through the bore and configured to engage the seat to pivotally couple the seat to the hinge post. The pintle includes a splined portion that engages the splined inner surface of the hinge post to prevent rotation of the pintle relative to the hinge post.

34 Claims, 4 Drawing Sheets

SELF-SUSTAINING TOILET SEAT HINGE ASSEMBLY

BACKGROUND

The present invention relates to toilet seat hinge assemblies and, more particularly, to self-sustaining toilet seat hinge assemblies.

A toilet typically includes a hinge assembly to pivotally couple a seat or ring and often a cover or lid to a bowl of the toilet. The hinge assembly allows the seat and the cover to move relative to the bowl between a lowered position and a raised position. Some hinge assemblies include self-sustaining elements or mechanisms that can maintain the seat and the cover in any raised position or at any angle against the force of gravity.

SUMMARY

In one embodiment, the invention provides a hinge assembly for a toilet. The toilet includes a bowl and a seat. The hinge assembly includes a hinge post configured to mount to the bowl. The hinge post includes a splined inner surface defining a bore. The hinge assembly also includes a pintle extending through the bore and configured to engage the seat to pivotally couple the seat to the hinge post. The pintle includes a splined portion that engages the splined inner surface of the hinge post to prevent rotation of the pintle relative to the hinge post.

In another embodiment, the invention provides a toilet seat assembly including a seat having an inner surface defining a bore, and a hinge post having an inner surface defining a bore. The bore of the hinge post is substantially aligned with the bore of the seat. The toilet seat assembly also includes a pintle extending through the bore of the seat and the bore of the hinge post to pivotally couple the seat to the hinge post. The pintle includes a splined portion and a non-splined portion. The splined portion engages the inner surface of one of the seat and the hinge post to prevent rotation of the pintle relative to the one of the seat and the hinge post. The non-splined portion engages the inner surface of the other of the seat and the hinge post.

In yet another embodiment, the invention provides a method of manufacturing a toilet seat assembly including a seat having an inner surface defining a bore. The method includes providing a hinge post including an inner surface defining a bore, providing a pintle including a splined portion and a non-splined portion, and substantially aligning the bore of the seat with the bore of the hinge post. The method also includes inserting the pintle through the bore of the seat and the bore of the hinge post to pivotally couple the seat to the hinge post, and broaching the inner surface of one of the seat and the hinge post with the splined portion of the pintle as the pintle is inserted through the bore of the one of the seat and the hinge post to prevent rotation of the pintle relative to the one of the seat and the hinge post.

In still another embodiment, the invention provides a method of manufacturing a toilet seat assembly including a seat having an inner surface defining a bore. The method includes providing a hinge post including an inner surface defining a bore. The bore of the hinge post has a diameter that is different than a diameter of the bore of the seat. The method also includes providing a pintle including a first portion having a first diameter and a second portion having a second diameter that is different than the first diameter, substantially aligning the bore of the seat with the bore of the hinge post, inserting the pintle through the bore of the seat and the bore of the hinge post to pivotally couple the seat to the hinge post, and engaging the inner surface of one of the seat and the hinge post with the first portion of the pintle. The first diameter of the pintle is substantially equal to the diameter of the bore of the one of the seat and the hinge post such that the first portion engages the inner surface with an interference fit to maintain the seat in any position between a raised position and a lowered position against the force of gravity.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting.

Figure 1:
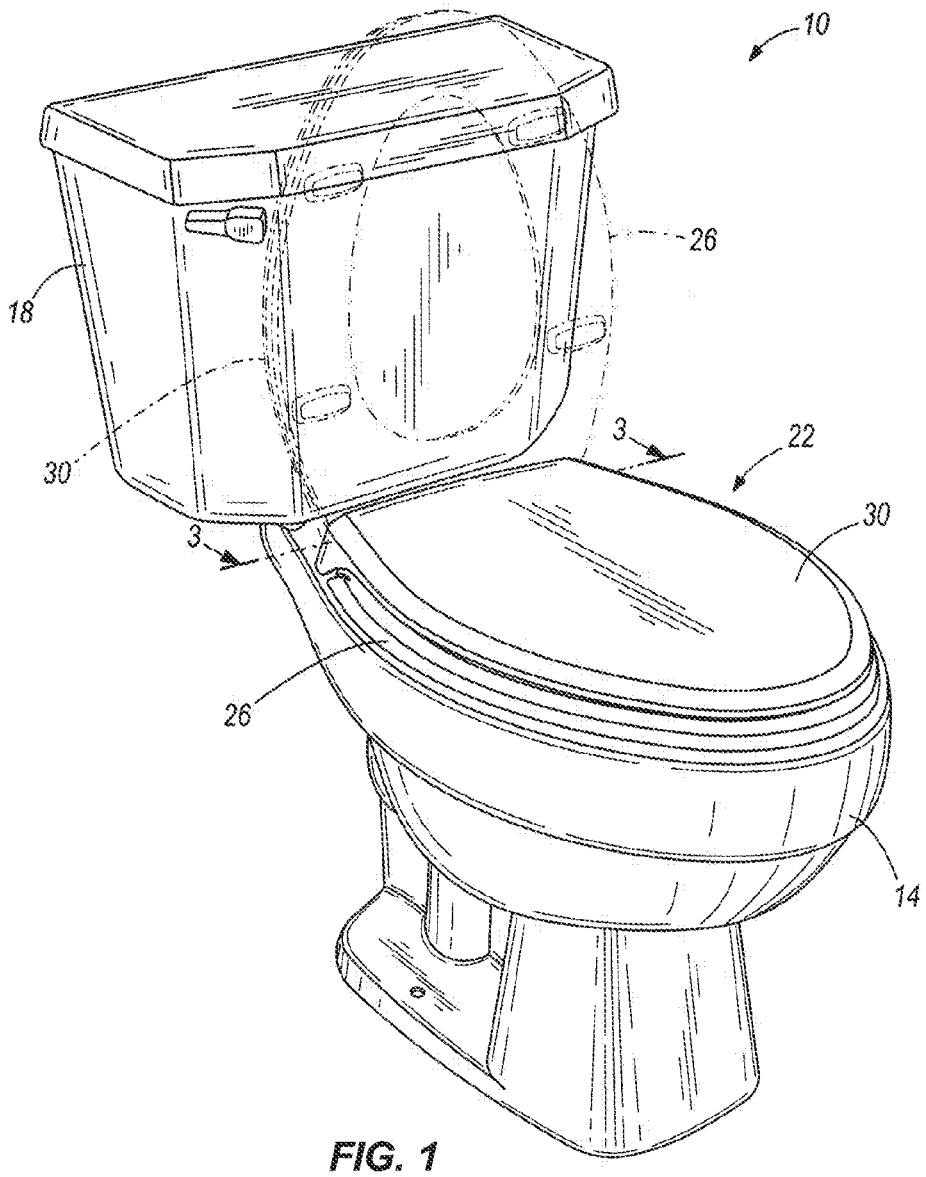
FIG. 1 is a front perspective view of a toilet including a seat assembly embodying the invention.
Figure 2:
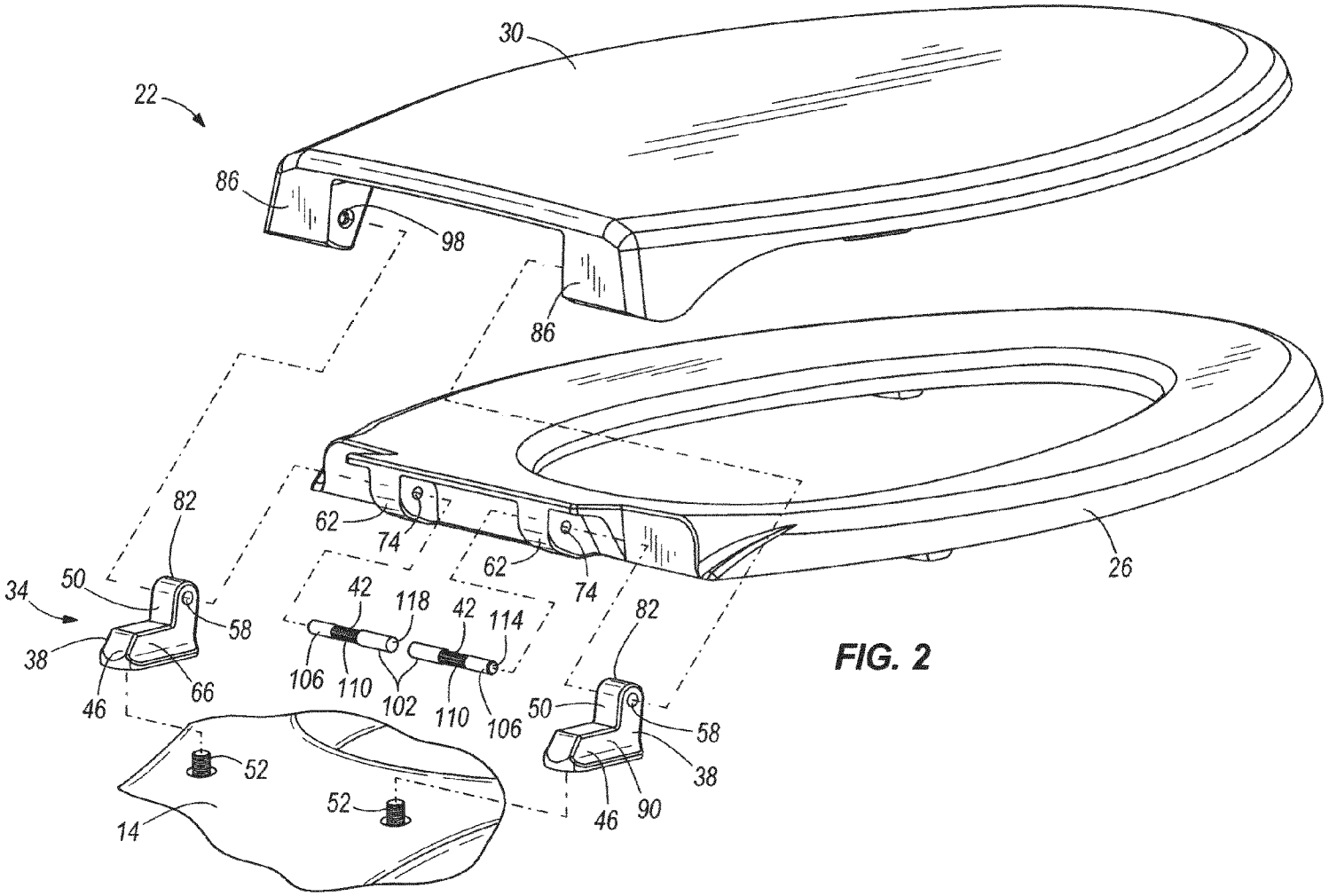
FIG. 2 is an exploded rear perspective view of the seat assembly shown in FIG. 1

FIG. 1 illustrates a toilet 10 including a bowl 14, a tank 18, and a seat assembly 22 embodying the invention. The seat assembly 22 is mounted to the bowl 14 and includes a seat or ring 26, a cover or lid 30, and a hinge assembly 34 (FIG. 2). The seat 26 and the cover 30 are movable between a lowered position (shown in solid lines) and a raised position (shown in phantom lines). The illustrated hinge assembly 34 is a self-sustaining hinge assembly that maintains the seat 26 and the cover 30 in an infinite number of positions between the raised and lowered positions against the force of gravity. The seat 26 and the cover 30 may be moved to the lowered, or closed, position when a user applies a force to the seat 26 and/or the cover 30. In the illustrated construction, the seat 26 and the cover 30 are maintained in their respective positions independent of each other and may be moved relative to one another between the raised position and the lowered position (e.g., the cover 30 may be raised while the seat 26 remains lowered). In other constructions, the cover 30 may be omitted such that the seat assembly 22 only includes the seat 26 and the hinge assembly 34.

Figure 3:
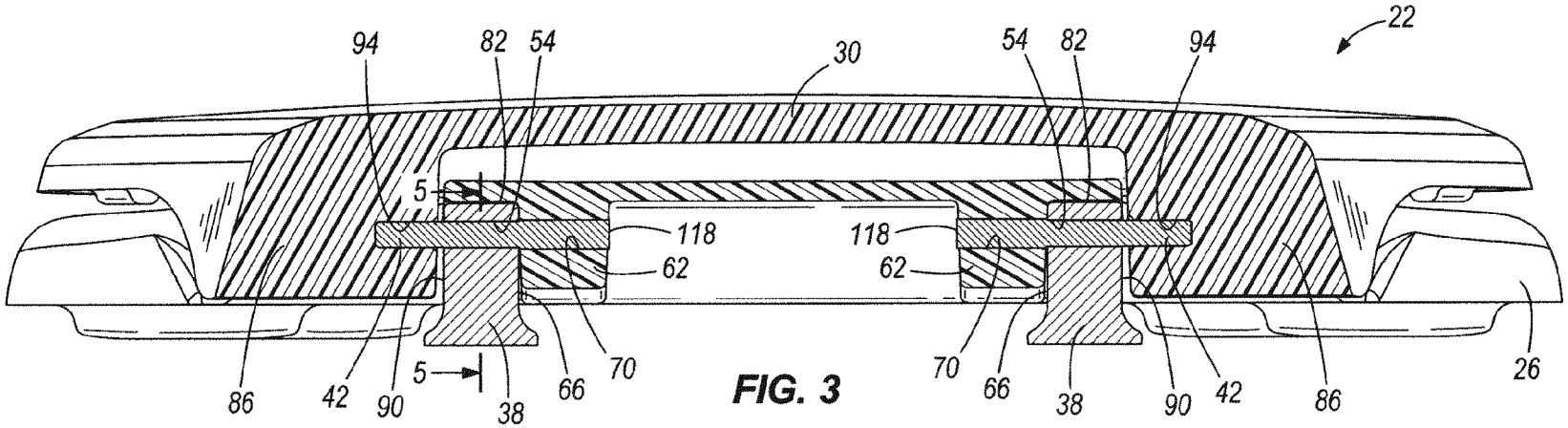
FIG. 3 is a cross-sectional view of the seat assembly taken along section line 3-3 of FIG. 1.

As shown in FIGS. 2 and 3, the illustrated hinge assembly 34 includes two hinge posts 38 and two pintles 42. In some constructions, the hinge assembly 34 may include a single hinge post 38 and a single pintle 42 to connect the seat 26 and the cover 30 to the toilet 10. Each hinge post 38 includes a base portion 46 configured to mount to the bowl 14 of the toilet 10 and a projection 50. In the illustrated construction, bolts or studs 52 are threaded into the hinge posts 38 and extend through the bowl 14 to connect the hinge posts 38 to the toilet 10. In other constructions, other suitable coupling means may be employed to secure the hinge posts 38 to the howl 14. The projections 50 are integrally formed with the base portions 46 and extend generally away from the bowl 14. Each projection 50 includes an inner surface 54 defining a bore 58. The bores 58 are configured to receive the pintles 42 to rotatably couple the seat 26 and the cover 30 to the hinge posts 38.

The seat 26 includes two leg portions 62 that project from the rear of the seat 26. In the illustrated construction, the leg portions 62 extend adjacent to inner faces 66 of the hinge posts 38. Each leg portion 62 includes an inner surface 70 defining a bore 74 configured to receive one of the pintles 42. The bores 74 of the seat 26 have a slightly larger diameter than the bores 58 of the hinge posts 38 to minimize interference between the inner surfaces 70 and portions of the pintles 42 during assembly. The illustrated seat 26 is composed of a plastic material, but may alternatively be composed of other suitable materials or combinations of materials.

Similar to the seat 26, the cover 30 includes two leg portions 86 that project from the rear of the cover 30. In the illustrated construction, the leg portions 86 extend adjacent to outer faces 90 of the hinge posts 38. Each leg portion 86 includes an inner surface 94 defining a blind bore 98 configured to receive one of the pintles 42. The bores 98 of the cover 30 have a slightly smaller diameter than the bores 58 of the hinge post 38. The illustrated cover 30 is composed of a plastic material, but may alternatively be composed of other suitable materials or combinations of materials.

Figure 4:
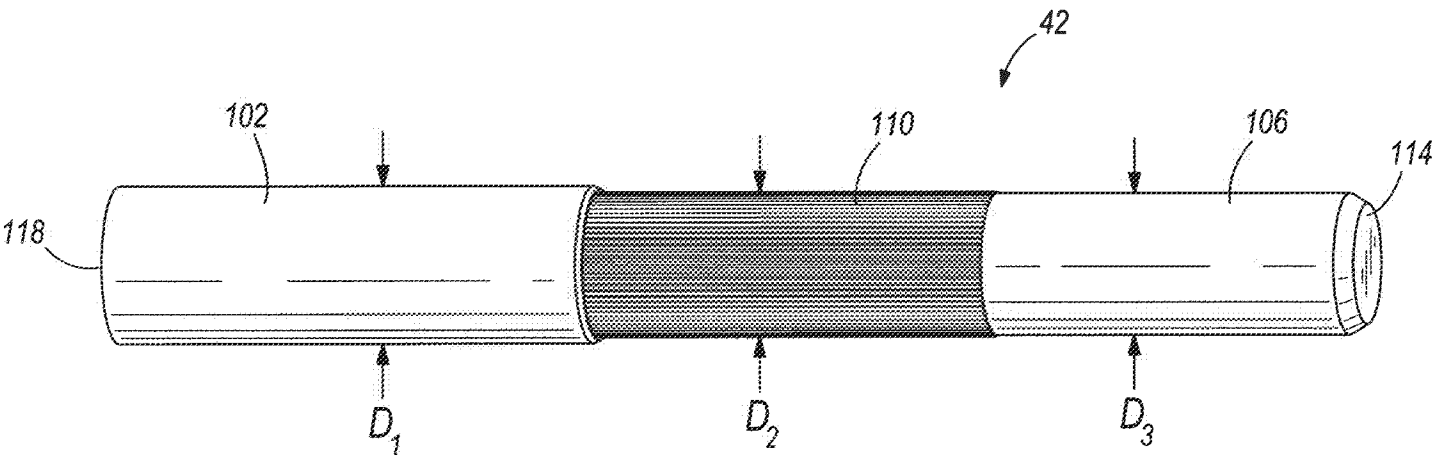
FIG. 4 is an enlarged side view of a pintle for use with the seat assembly.

FIG. 4 illustrates one of the pintles 42 in more detail. Both pintles 42 are substantially the sane and, as such, only one pintle 42 is shown in FIG. 4 and described in detail below. The illustrated pintle 42 is a generally elongated shaft and includes a first non-splined portion 102, a second non-splined portion 106, and a splined portion 110 between the non-splined portions 102, 106. In the illustrated construction, an end 114 of the non-splined portion 106 is tapered or beveled to facilitate insertion of the pintle 42 into the seat 26, the hinge post 38, and the cover 30.

The non-splined portions 102, 106 engage the inner surfaces 70, 94 (FIG. 3) of the seat 26 and the cover 30, respectively, with an interference fit to provide the self-sustaining function. These interference fits inhibit pivotal movement of the seat 26 and the cover 30 relative to the pintle 42, and thereby the bowl 14, unless a user applies a force to the seat 26 and/or the cover 30.

Referring to FIG. 3, to assemble the seat assembly 22 and mount the assembly 22 to the toilet 10, the seat 26 and the cover 30 are positioned such that the bores 74, 98 formed in the seat 26 and the cover 30 substantially align with the bores 58 formed in the hinge posts 38. Once the bore 58, 74, 98 are aligned, the pintles 42 are inserted through the bores 74 in the seat 26, then through the bores 58 in the hinge posts 38, and finally into the blind bores 98 in the cover 30. In other constructions, the relative positions of the seat 26, the hinge posts 38, and the cover 30 may be adjusted such that the pintles 42 are inserted into the bores 58, 74, 98 in a different order. After the seat assembly 22 is assembled, the assembly 22 is mounted to the toilet 10 by inserting the studs 52 extending from the hinge posts 38 through the bowl 14 and tightening corresponding nuts onto the studs 52.

Figure 5:
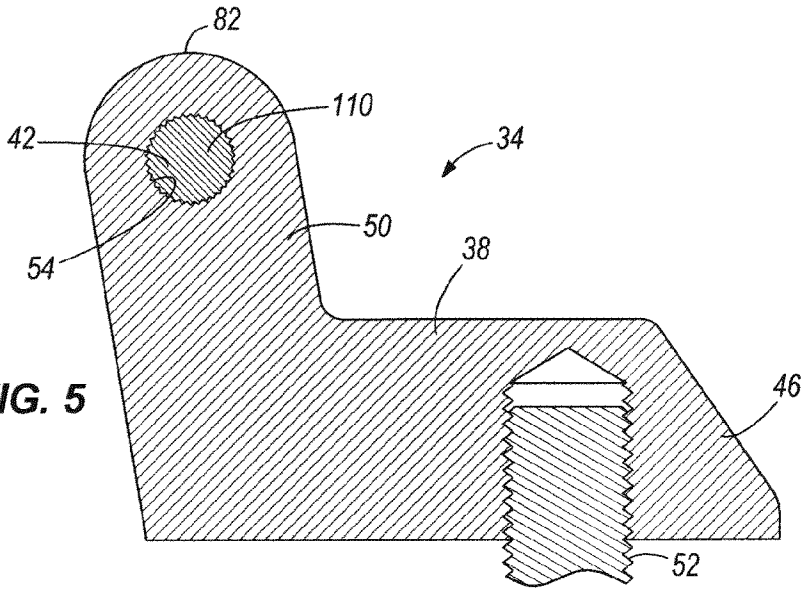
FIG. 5 is a cross-sectional view of a portion of the seat assembly taken along section line 5-5 of FIG. 3.

As the pintle 42 is inserted through the bore 58, the splined portion 110 of the pintle 42 broaches the inner surface 54 (FIG. 3) of the hinge post 38 to form corresponding grooves or splines on the inner surface 54. To this end, the pintle 42 is generally composed of a harder material than the hinge post 38. For example, the illustrated pintle 42 is composed of stainless steel and the hinge post 38 is composed of chrome-plated aluminum. When the pintle 42 is inserted through the bore 58 of the hinge post 38, the relatively harder material of the pintle 42 cuts through the relatively softer material of the hinge post 38 to broach the inner surface 54. The splines of the pintle 42 and the hinge post 38 inter-engage, as shown in FIG. 5, to prevent rotation of the pintle 42 relative to the hinge post 38.

As is known in the art, a pintle pusher is used to push the pintle 42 through the hinge post 38 with sufficient force to broach the inner surface 54. For example, the pintles 42 may be simultaneously and continuously pushed into the hinge posts 38 by arms of a pneumatically-driven pintle pusher. In other constructions, other suitable tools or machines may be employed.

In other constructions, the inner surface 54 of the hinge post 38 may be pre-broached or pre-splined to generally match the shape and contour of the splined portion 110 of the pintle 42. In still other constructions, the hinge post 38 may be composed of a relatively harder material than the pintle 42, and the inner surface 54 may be splined to broach the pintle 42 as the pintle 42 is inserted through the bore 58.

In some constructions, the relative positions of the non-splined portions 102, 106 and the splined portion 110 may be adjusted to match the relative positions of the seat 26, the cover 30, and the hinge posts 38. For example, in other constructions, the leg portions 62 of the seat 26 may extend adjacent to the outer faces 90 of the hinge posts 38 and the leg portions 86 of the cover 30 may extend adjacent to the inner faces 66 of the hinge posts 38. Alternatively, the leg portions 62, 86 of the seat 26 and the cover 30 may both be positioned on the same side of each corresponding hinge post 38.

In constructions where the cover 30 is omitted, the splined portion 110 of each pintle 42 may correspond to the seat 26 and the non-splined portion 102 may correspond to one of the hinge posts 38. In such constructions, the splined portions 110 may broach the inner surfaces 70 of the seat 26 to prevent rotation of the pintle 42 relative to the seat 26. Furthermore, the non-splined portions 102 may engage the inner surfaces 54 of the hinge posts 38 with an interference fit to provide the self-sustaining function.

As shown in FIG. 4, each portion 102, 106, 110 of the pintle 42 has a substantially different outer diameter. The non-splined portion 102 has a first diameter $D_1$, the splined portion 110 has a second diameter $D_2$, and the non-splined portion 106 has a third diameter $D_3$. The outer diameter $D_1$ is substantially equal to the inner diameter of the bore 74 in the seat 26 to tightly engage the inner surface 70 with the interference fit. The outer diameter $D_2$ is slightly larger than the inner diameter of the bore 58 in the hinge post 38 such that the splined portion 110 cuts into the inner surface 54 as the pintle 42 is inserted into the hinge post 38. However, the outer diameter $D_2$ is smaller than the outer diameter $D_1$, and thereby the inner diameter of the bore 74, such that the splined portion 110 passes through the bore 74 with little interference. The outer diameter $D_3$ is substantially equal to the inner diameter of the bore 98 in the cover 30 to tightly engage the inner surface 94 with the interference fit. However, the outer diameter $D_3$ is smaller than the other outer diameters $D_1$, $D_2$, and thereby the inner diameters of the bores 58, 74, such that the non-splined portion 106 passes through the bores 74, 58 with little interference.

Although the invention has been described in detail with reference to preferred embodiments, variations and modifications exist within the scope and spirit of one or more independent aspects of the invention as described. Various features and advantages of the invention are set forth in the following claims.

What is claimed is:

1. A hinge assembly for a toilet, the toilet including a bowl and a seat, the hinge assembly comprising:

a hinge post configured to mount to the bowl, the hinge post including a splined inner surface defining a bore; and a single-piece pintle extending through the bore and configured to engage the seat to pivotally couple the seat to the hinge post, the pintle including a splined portion that engages the splined inner surface of the hinge post to prevent rotation of the pintle relative to the hinge post;

wherein the pintle further includes a non-splined portion extending outwardly from the hinge post, and wherein the non-splined portion is configured to engage the seat with an interference fit to maintain the seat in any position between a raised position and a lowered position against the force of gravity.

2. The hinge assembly of claim 1, wherein the non-splined portion has a first diameter and the splined portion has a second diameter that is different than the first diameter.

3. The hinge assembly of claim 1, wherein the toilet further includes a cover, wherein the non-splined portion is a first non-splined portion and the pintle further includes a second non-splined portion extending outwardly from the hinge post, and wherein the second non-splined portion is configured to engage the cover with an interference fit to maintain the cover in any position between a raised position and a lowered position against the force of gravity.

4. The hinge assembly of claim 3, wherein the splined portion is between the first non-splined portion and the second non-splined portion, and wherein the first and second non-splined portions extend outwardly from the hinge post in opposite directions.

5. The hinge assembly of claim 4, wherein the hinge post is configured to extend between a portion of the seat and a portion of the cover, wherein the first non-splined portion is configured to extend into a bore formed in the portion of the seat, and wherein the second non-splined portion is configured to extend into a bore formed in the portion of the cover.

6. The hinge assembly of claim 3, wherein the first non-splined portion has a first diameter, the splined portion has a second diameter, and the second non-splined portion has a third diameter, and wherein the second diameter is generally larger than one of the first and third diameters and is generally smaller than the other of the first and third diameters.

7. The hinge assembly of claim 1, wherein the hinge post is composed of a first material and the pintle is composed of a second material that is generally harder than the first material.

8. The hinge assembly of claim 7, wherein the hinge post is generally composed of aluminum and the pintle is generally composed of stainless steel.

9. A toilet seat assembly comprising:

a seat including an inner surface defining a bore;

a cover including an inner surface defining a bore;

a hinge post including an inner surface defining a bore, the bore of the hinge post being substantially aligned with the bore of the seat and with the bore of the cover; and a single-piece pintle extending through the bore of the seat, the bore of the cover, and the bore of the hinge post to pivotally couple the seat and the cover to the hinge post, the pintle including a splined portion, a first non-splined portion, and a second non-splined portion, the splined portion engaging the inner surface of the hinge post to prevent rotation of the pintle relative to the hinge post, the first non-splined portion engaging the inner surface of the seat, and the second non-splined portion engaging the inner surface of the cover;

wherein the first non-splined portion engages the inner surface of the seat with an interference fit to maintain the seat in any position between a raised position and a lowered position against the force of gravity, and wherein the second non-splined portion engages the inner surface of the cover with an interference fit to maintain the cover in any position between a raised position and a lowered position against the force of gravity.

10. The toilet seat assembly of claim 9, wherein the first non-splined portion has a first diameter and the splined portion has a second diameter that is different than the first diameter.

11. The toilet seat assembly of claim 9, wherein the hinge post is positioned substantially between a portion of the seat and a portion of the cover, wherein the splined portion of the pintle is between the first non-splined portion and the second non-splined portion, and wherein the first and second non-splined portions extend outwardly from the hinge post in opposite directions.

12. The toilet seat assembly of claim 9, wherein the first non-splined portion has a first diameter, the splined portion has a second diameter, and the second non-splined portion has a third diameter, and wherein the second diameter is generally larger than one of the first and third diameters and is generally smaller than the other of the first and third diameters.

13. The toilet seat assembly of claim 9, wherein the seat includes a second inner surface defining a second bore, and further comprising:

a second hinge post including an inner surface defining a bore, the bore of the second hinge post being substantially aligned with the second bore of the seat, and a second pintle extending through the second bore of the seat and the bore of the second hinge post to pivotally couple the seat to the second hinge post, the second pintle including a splined portion and a non-splined portion, the splined portion engaging one of the second inner surface of the seat and the inner surface of the second hinge post to prevent rotation of the pintle relative to the one of the seat and the second hinge post, the non-splined portion engaging the other of the second inner surface of the seat and the inner surface of the second hinge post.

14. The toilet seat assembly of claim 9, wherein the hinge post is composed of a first material and the pintle is composed of a second material that is generally harder than the first material.

15. A method of manufacturing a toilet seat assembly including a seat having an inner surface defining a bore, the method comprising:

providing a hinge post including an inner surface defining a bore;

providing a pintle including a splined portion and a non-splined portion;

substantially aligning the bore of the seat with the bore of the hinge post;

inserting the pintle through the bore of the seat and the bore of the hinge post to pivotally couple the seat to the hinge post; and broaching the inner surface of the hinge post with the splined portion of the pintle as the pintle is inserted through the bore of the hinge post to prevent rotation of the pintle relative to the hinge post.

16. The method of claim 15, further comprising engaging the inner surface of the seat with the non-splined portion of the pintle by an interference fit to maintain the seat in any position between a raised position and a lowered position against the force of gravity.

17. The method of claim 15, wherein providing the pintle includes providing the pintle having the non-splined portion with a first diameter and the splined portion with a second diameter that is different than the first diameter.

18. The method of claim 15, wherein inserting the pintle includes first inserting the pintle through the bore of the seat and then inserting the pintle through the bore of the hinge post.

19. The method of claim 15, wherein the toilet seat assembly also includes a cover having an inner surface defining a bore, and further comprising:

substantially aligning the bore of the cover with the bore of the hinge post, and inserting the pintle into the bore of the cover to pivotally couple the cover to the hinge post.

20. The method of claim 19, wherein the non-splined portion is a first non-splined portion, wherein providing the pintle includes providing the pintle having a second non-splined portion, and further comprising:

engaging the inner surface of the seat with the first non-splined portion by an interference fit to maintain the seat in any position between a raised position and a lowered position against the force of gravity, and engaging the inner surface of the cover with the second non-splined portion by an interference fit to maintain the cover in any position between a raised position and a lowered position against the force of gravity.

21. The method of claim 20, wherein providing the pintle includes providing the pintle having the first non-splined portion with a first diameter, the splined portion with a second diameter, and the second non-splined portion with a third diameter, and wherein the second diameter is generally larger than one of the first and third diameters and is generally smaller than the other of the first and third diameters.

22. The method of claim 19, further comprising positioning the hinge post substantially between a portion of the seat and a portion of the cover.

23. The method of claim 22, wherein inserting the pintle includes first inserting the pintle through the bore in the seat, then inserting the pintle through the bore in the hinge post, and then inserting the pintle into the bore in the cover.

24. The method of claim 15, wherein providing the hinge post includes providing the hinge post composed of a first material, and wherein providing the pintle includes providing the pintle composed of a second material that is generally harder than the first material.

25. A method of manufacturing a toilet seat assembly including a seat having an inner surface defining a bore, the method comprising:

providing a hinge post including an inner surface defining a bore, the bore of the hinge post having a diameter that is different than a diameter of the bore of the seat;

providing a pintle including a first portion having a first diameter and a second portion having a second diameter that is different than the first diameter, the second portion being a splined portion;

substantially aligning the bore of the seat with the bore of the hinge post;

inserting the pintle through the bore of the seat and the bore of the hinge post to pivotally couple the seat to the hinge post, splined portion of the pintle engaging the hinge post to prevent rotation of the pintle relative to the hinge post; and engaging the inner surface of the seat with the first portion of the pintle, the first diameter of the pintle being substantially equal to the diameter of the bore of the seat such that the first portion engages the inner surface with an interference fit to maintain the seat in any position between a raised position and a lowered position against the force of gravity.

26. The method of claim 25, wherein the first portion of the pintle is a non-splined portion, wherein the second diameter of the pintle is slightly larger than the diameter of the bore of the hinge post, and further comprising wherein securing the second portion of the pintle to the inner surface of the other of the broaching the inner surface of the hinge post with the splined portion of the pintle to prevent rotation of the pintle relative to the hinge post.

27. The method of claim 25, wherein inserting the pintle includes first inserting the pintle through the bore of the seat and then inserting the pintle through the bore of the hinge post.

28. The method of claim 25, wherein the toilet seat assembly includes a cover having an inner surface defining a bore, the bore of the cover having a diameter that is different than the diameters of the bores of the seat and the hinge post, wherein the pintle includes a third portion having a third diameter that is different than the first and second diameters, and further comprising:

substantially aligning the bore of the cover with the bore of the hinge post, inserting the pintle into the bore of the cover to pivotally couple the cover to the hinge post, and engaging the inner surface of the cover with the third portion of the pintle, the third diameter of the pintle being substantially equal to the diameter of the bore of the cover to maintain the cover in any position between a raised position and a lowered position against the force of gravity.

29. The method of claim 28, further comprising positioning the hinge post substantially between a portion of the seat and a portion of the cover.

30. The method of claim 29, wherein the first portion of the pintle engages the inner surface of the seat, wherein the first diameter is generally larger than the second and third diameters and the second diameter is generally larger than the third diameter, and wherein inserting the pintle includes first inserting the pintle through the bore in the seat, then inserting the pintle through the bore in the hinge post, and then inserting the pintle into the bore in the cover.

31. The hinge assembly of claim 1, wherein the non-splined portion of the pintle has a generally circular cross-section.

32. The hinge assembly of claim 9, wherein the non-splined portion of the pintle has a generally circular cross-section.

33. The method of claim 25, further comprising mounting the hinge post to a toilet bowl before inserting the pintle through the bore of the seat and the bore of the hinge post.

34. The method of claim 25, wherein providing the pintle includes providing the pintle as a single piece.

* * * * *